US011737202B2

(12) United States Patent
Liu et al.

(10) Patent No.: US 11,737,202 B2
(45) Date of Patent: Aug. 22, 2023

(54) METHOD, APPARATUS AND SYSTEM FOR CONTROLLING STANDING WAVE LINEAR ACCELERATOR

(71) Applicant: NUCTECH COMPANY LIMITED, Beijing (CN)

(72) Inventors: Yaohong Liu, Beijing (CN); Jinsheng Liu, Beijing (CN); Wei Jia, Beijing (CN); Wei Yin, Beijing (CN); Feng Gao, Beijing (CN); Xiying Liu, Beijing (CN); Haokun Wang, Beijing (CN)

(73) Assignee: NUCTECH COMPANY LIMITED, Beijing (CN)

( * ) Notice: Subject to any disclaimer, the term of this patent is extended or adjusted under 35 U.S.C. 154(b) by 316 days.

(21) Appl. No.: 17/247,800

(22) Filed: Dec. 23, 2020

(65) Prior Publication Data

US 2021/0204390 A1 Jul. 1, 2021

(30) Foreign Application Priority Data

Dec. 25, 2019 (CN) ..... 201911363043.5

(51) Int. Cl.
*H05H 9/04* (2006.01)
*H05H 7/02* (2006.01)

(52) U.S. Cl.
CPC ..... *H05H 9/04* (2013.01); *H05H 7/02* (2013.01); *H05H 2007/027* (2013.01)

(58) Field of Classification Search
None
See application file for complete search history.

(56) References Cited

U.S. PATENT DOCUMENTS 6,674,254 B2 * 1/2004 Hanna ..... H05H 7/18 315/505
8,232,748 B2 * 7/2012 Treas ..... H05H 7/02 250/397
8,311,187 B2 * 11/2012 Treas ..... H01J 35/16 315/505
8,384,314 B2 * 2/2013 Treas ..... H05H 7/02 250/397

(Continued)

FOREIGN PATENT DOCUMENTS

EP 2382850 B1 * 8/2016 ..... H05H 7/02

*Primary Examiner* — Srinivas Sathiraju
(74) *Attorney, Agent, or Firm* — Knobbe, Martens, Olson & Bear, LLP

(57) ABSTRACT

Embodiments of the disclosed technology provide an apparatus for controlling a standing wave linear accelerator. An example standing wave linear accelerator includes an accelerating tube, a motor, and a microwave power source connected between the accelerating tube and the motor. An example apparatus includes a main processor configured to receive an envelope signal of a reflected wave signal output by the accelerating tube, determine whether an amplitude of the envelope signal is greater than an envelope threshold, and if it is determined that the amplitude of the envelope signal is less than the envelope threshold, determine whether to change a rotation direction of the motor by comparing the amplitude of the envelope signal with an envelope reference signal stored in a memory. The memory is connected to the main processor and is configured to store the envelope threshold and the envelope reference signal.

20 Claims, 3 Drawing Sheets

(56) References Cited

U.S. PATENT DOCUMENTS 9,426,876 B2 * 8/2016 Treas ..... H05H 9/02
9,426,877 B2 * 8/2016 Tang ..... H05H 9/048
9,446,263 B2 * 9/2016 Dempsey ..... G01R 33/422
9,622,333 B2 * 4/2017 Nighan, Jr. ..... H05H 9/048
9,661,734 B2 * 5/2017 Nighan, Jr. ..... H05H 7/02
10,420,201 B2 * 9/2019 Nighan, Jr. ..... H05H 7/02
10,463,884 B2 * 11/2019 Dempsey ..... G01R 33/422
10,757,798 B2 * 8/2020 Nighan, Jr. ..... H05H 9/048
11,083,912 B2 * 8/2021 Dempsey ..... G01R 33/4808
2003/0030391 A1 * 2/2003 Hanna ..... H05H 7/18 315/505
2010/0002843 A1 * 1/2010 Liu ..... H05H 9/04 378/138
2010/0188027 A1 * 7/2010 Treas ..... H05H 7/02 315/505
2010/0219776 A1 * 9/2010 Liu ..... H05H 7/02 315/501
2012/0081041 A1 * 4/2012 Cheung ..... H05H 7/12 315/505
2012/0294423 A1 * 11/2012 Cheung ..... H05H 9/02 378/65
2013/0016814 A1 * 1/2013 Treas ..... H05H 7/12 315/505
2014/0185775 A1 * 7/2014 Tang ..... H05H 7/22 315/5.41
2014/0266208 A1 * 9/2014 Dempsey ..... G01R 33/421 29/601
2015/0245462 A1 * 8/2015 Nighan, Jr. ..... H05H 9/048 378/138
2015/0245463 A1 * 8/2015 Nighan, Jr. ..... H05H 7/02 315/505
2017/0001039 A1 * 1/2017 Dempsey ..... A61N 5/1049
2020/0015346 A1 * 1/2020 Nighan, Jr. ..... G01V 5/0016
2020/0038688 A1 * 2/2020 Dempsey ..... A61N 5/1049
2021/0204390 A1 * 7/2021 Liu ..... H05H 7/02
2021/0364620 A1 * 11/2021 Sun ..... G01S 7/40

* cited by examiner

METHOD, APPARATUS AND SYSTEM FOR CONTROLLING STANDING WAVE LINEAR ACCELERATOR

CROSS-REFERENCE TO RELATED APPLICATIONS

Any and all applications for which a foreign or domestic priority claim is identified in the Application Data Sheet as filed with the present application are hereby incorporated by reference under 37 CFR 1.57.

This application claims priority to Chinese Patent App. No. 201911363043.5, which was filed on Dec. 25, 2019 and which is hereby incorporated herein by reference in its entirety.

BACKGROUND OF THE DISCLOSED TECHNOLOGY

Field

The disclosed technology relates to a field of accelerator, and in particular to a method, apparatus and system for controlling a standing wave linear accelerator.

Description of the Related Technology

An Automatic Frequency Control (AFC) system used in a standing wave linear accelerator usually adopts a phase-locked frequency detection AFC system or a minimum reflected wave AFC system. The phase-locked frequency detection AFC system is composed of a microwave circuit and an electronic circuit. Incident wave and reflected wave of the accelerator are used as two input signals of the microwave circuit in the phase-locked frequency detection AFC system. These two input signals are then processed by the microwave circuit composed of a variable attenuator, a phase shifter and a hybrid ring, and detected respectively by two crystal detectors to generate two electrical signals. The electronic circuit in the phase-locked frequency detection AFC system subtracts the two electrical signals output by the detectors. If a subtraction result is zero, it means that a microwave frequency input from a magnetron to the accelerating tube is consistent with a resonance frequency of the accelerating tube, and there is no need to adjust the microwave frequency output by the magnetron. If the subtraction result is positive or negative, it means that the microwave frequency output by the magnetron needs to be adjusted until the subtraction result of the electrical signals output by the two detectors is zero. The microwave circuit in the minimum reflected wave AFC system only receives the reflected wave signal, performs a mode conversion on the reflected wave signal, and inputs the converted signal to a complex programmable logic device (CPLD). The CPLD controls a tuning motor of the magnetron according to the converted signal, so as to keep the reflected wave in the minimum value state.

However, the microwave circuit in the phase-locked frequency detection AFC system widely used now has a complex structure, is difficult to debug, and is easily affected by the external environment, resulting in poor reliability and stability. In addition, for the minimum reflected wave AFC system, if the reflected wave enters a total reflection state, the minimum reflected wave AFC system cannot correctly give a rotation direction of a motor according to a control algorithm, and CPLD resources are limited and cannot realize more complicated control algorithm.

SUMMARY

According to an aspect of the disclosed technology, an apparatus for controlling a standing wave linear accelerator is provided, wherein the standing wave linear accelerator includes an accelerating tube, a motor, and a microwave power source connected between the accelerating tube and the motor, the apparatus including:

a main processor configured to: receive an envelope signal of a reflected wave signal output by the accelerating tube, determine whether an amplitude of the envelope signal is greater than an envelope threshold, and if it is determined that the amplitude of the envelope signal is less than the envelope threshold, determine whether to change a rotation direction of the motor by comparing the amplitude of the envelope signal with an envelope reference signal stored in a memory; and the memory connected to the main processor and configured to store the envelope threshold and the envelope reference signal.

According to an embodiment of the disclosed technology, the main processor is further configured to:

determine to change the rotation direction of the motor if the amplitude of the envelope signal is greater than the envelope reference signal; and determine to keep the rotation direction of the motor unchanged if the amplitude of the envelope signal is not greater than the envelope reference signal.

According to an embodiment of the disclosed technology, the main processor is further configured to:

replace the envelope reference signal with the amplitude of the envelope signal and store the amplitude of the envelope signal in the memory.

According to an embodiment of the disclosed technology, the main processor is further configured to:

if it is determined that the amplitude of the envelope signal is greater than the envelope threshold, receive a digital pulse current signal from the microwave power source, determine a preset position of the motor based on the digital pulse current signal, and adjust the motor to the preset position.

According to an embodiment of the disclosed technology, the main processor is further configured to:

determine the preset position of the motor by searching a pre-stored mapping relation table between the digital pulse current signal and the preset position based on the digital pulse current signal.

According to an embodiment of the disclosed technology, the apparatus further includes:

a first preprocessor connected between the main processor and the accelerating tube and configured to: receive the reflected wave signal from the accelerating tube, process the reflected wave signal to generate the envelope signal, and transmit the envelope signal to the main processor; and a second preprocessor connected between the main processor and the microwave power source and configured to: receive an analog pulse current signal from the microwave power source, process the analog pulse current signal to generate the digital pulse current signal, and transmit the digital pulse current signal to the main processor.

According to an embodiment of the disclosed technology, the first pre-processor includes an attenuator, a detector, a first analog-to-digital converter, and a filter, wherein:

the attenuator is connected to the accelerating tube and configured to attenuate the reflected wave signal to generate an attenuated signal;

the detector is connected to the attenuator and configured to detect the attenuated signal to generate a detected signal representing an envelope of the attenuated signal;

the first analog-to-digital converter is connected to the detector and configured to perform an analog-to-digital conversion on the detected signal to generate a first converted signal; and the filter is connected between the first analog-to-digital converter and the main processor and configured to filter the first converted signal to generate a first filtered signal as the envelope signal.

According to an embodiment of the disclosed technology, the second pre-processor includes a second analog-to-digital converter and a filter, wherein:

the second analog-to-digital converter is connected to the microwave power source and configured to perform an analog-to-digital conversion on the analog pulse current signal to generate a second converted signal; and the filter is connected between the second analog-to-digital converter and the main processor and configured to filter the second converted signal to generate a second filtered signal as the digital pulse current signal.

According to an embodiment of the disclosed technology, the microwave power source is a magnetron or a klystron.

According to another aspect of the disclosed technology, a method of controlling a standing wave linear accelerator is provided, wherein the standing wave linear accelerator includes an accelerating tube, a motor, and a microwave power source connected between the accelerating tube and the motor, the method including:

receiving an envelope signal of a reflected wave signal output by the accelerating tube; and determining whether an amplitude of the envelope signal is greater than an envelope threshold, and if it is determined that the amplitude of the envelope signal is less than the envelope threshold, determining whether to change a rotation direction of the motor by comparing the amplitude of the envelope signal with an envelope reference signal stored in a memory.

According to an embodiment of the disclosed technology, the determining whether to change a rotation direction of the motor by comparing the amplitude of the envelope signal with an envelope reference signal includes:

determining to change the rotation direction of the motor if the amplitude of the envelope signal is greater than the envelope reference signal; and determining to keep the rotation direction of the motor unchanged if the amplitude of the envelope signal is not greater than the envelope reference signal.

According to an embodiment of the disclosed technology, the method further includes:

replacing the envelope reference signal with the amplitude of the envelope signal, and storing the amplitude of the envelope signal in the memory.

According to an embodiment of the disclosed technology, the method further includes:

if it is determined that the amplitude of the envelope signal is greater than the envelope threshold, receiving a digital pulse current signal from the microwave power source, determining a preset position of the motor based on the digital pulse current signal, and adjusting the motor to the preset position.

According to an embodiment of the disclosed technology, the determining a preset position of the motor based on the digital pulse current signal includes:

determining the preset position of the motor by searching a pre-stored mapping relation table between the digital pulse current signal and the preset position based on the digital pulse current signal.

According to an embodiment of the disclosed technology, the microwave power source is a magnetron or a klystron.

BRIEF DESCRIPTION OF THE DRAWINGS

The above and other objects, features, and advantages of the disclosed technology will be more apparent through the following description of embodiments of the disclosed technology with reference to the accompanying drawings, in which.

The drawings do not show all circuits or structures of the embodiments. The same reference numbers throughout the drawings indicate the same or similar components or features.

DETAILED DESCRIPTION OF CERTAIN ILLUSTRATIVE EMBODIMENTS

Embodiments of the disclosed technology will be described below with reference to the drawings. It should be understood, however, that these descriptions are merely exemplary and are not intended to limit the scope of the disclosed technology. In addition, in the following description, descriptions of well-known structures and technologies are omitted to avoid unnecessarily obscuring the concepts of the disclosed technology.

The terms used herein are for the purpose of describing specific embodiments only and are not intended to limit the disclosed technology. The words "a", "an" and "the" as used herein should also include the meaning of "a plurality of" and "multiple" unless the context clearly indicates otherwise. In addition, the terms "including", "comprising" and the like indicate the presence of features, steps, operations, and/or components, but do not exclude the presence or addition of one or more other features, steps, operations, or components.

All terms used herein (including technical and scientific terms) have the meanings generally understood by those skilled in the art, unless otherwise defined. It should be noted that the terms used herein shall be interpreted to have meanings consistent with the context of this specification, and shall not be interpreted in an idealized or too rigid way.

Figure 1:
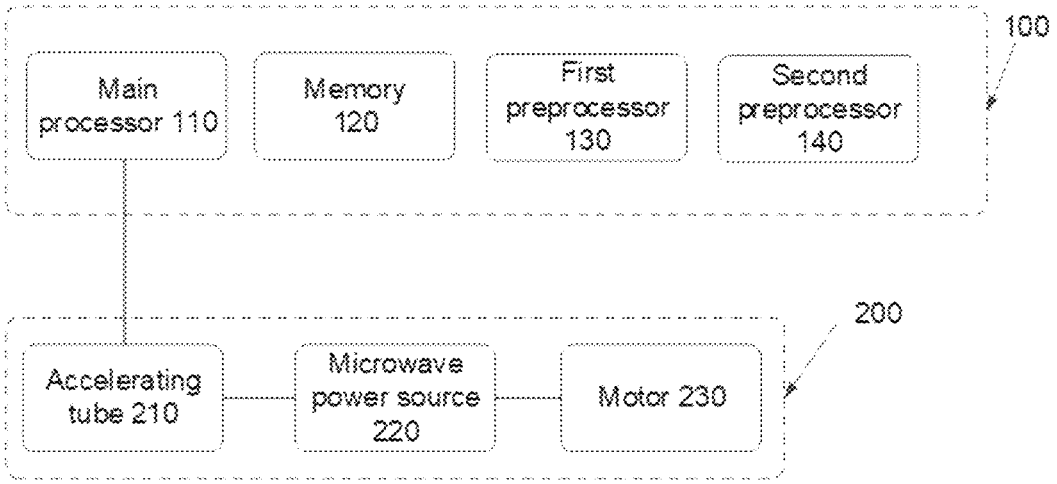
FIG. 1 shows a block diagram of an apparatus for controlling a standing wave linear accelerator according to an embodiment of the disclosed technology.

FIG. 1 shows a block diagram of an apparatus 100 of controlling a standing wave linear accelerator 200 according to an embodiment of the disclosed technology. The standing wave linear accelerator 200 may include a microwave power source 220, an accelerating tube 210 and a motor 230. The microwave power source 220 may be connected between the accelerating tube 210 and the motor 230. The microwave power source 220 may be a magnetron or a klystron. When an output frequency of the microwave power source 220 is the same as a resonance frequency of the accelerating tube 210, the reflected wave output by the accelerating tube 210 has the minimum amplitude, and the rays output by the accelerating tube 210 are the most stable and have the maximum radiation dose (e.g., a measure associated with the output rays).

The apparatus 100 may include a main processor 110 and a memory 120 connected to the main processor 110. The main processor 110 may be configured to: receive an envelope signal of a reflected wave signal output by the accelerating tube 210, determine whether an amplitude of the envelope signal is greater than an envelope threshold, and if it is determined that the amplitude of the envelope signal is less than the envelope threshold, determine whether to change a rotation direction of the motor 230 by comparing the amplitude of the envelope signal with an envelope reference signal stored in a memory. The memory 120 may be configured to store the envelope threshold and the envelope reference signal. The main processor 110 may be further configured to: determine to change the rotation direction of the motor 230 so as to change the microwave frequency of the microwave power source 220 if the amplitude of the envelope signal is greater than the envelope reference signal; and determine to keep the rotation direction of the motor 230 unchanged if the amplitude of the envelope signal is not greater than the envelope reference signal.

The main processor 110 may be further configured to: if it is determined that the amplitude of the envelope signal is less than the envelope threshold, replace the envelope reference signal with the amplitude of the envelope signal and store the amplitude of the envelope signal in the memory.

The main processor 110 may be further configured to: if it is determined that the amplitude of the envelope signal is greater than the envelope threshold, receive a digital pulse current signal from the microwave power source 220, determine a preset position of the motor 230 based on the digital pulse current signal, and adjust the motor 230 to the preset position. The main processor 110 may be further configured to: determine the preset position of the motor 230 by searching a pre-stored mapping relation table between the digital pulse current signal and the preset position based on the digital pulse current signal.

The apparatus 100 may further include a first preprocessor 130 and a second preprocessor 140. The first preprocessor 130 may be connected between the accelerating tube 210 and the main processor 110 and configured to: receive the reflected wave signal from the accelerating tube 210, process the reflected wave signal to generate the envelope signal, and transmit the envelope signal to the main processor 110.

The first pre-processor 130 may include an attenuator, a detector, a first analog-to-digital converter, and a filter. The attenuator may be connected to the accelerating tube 210 and configured to attenuate the reflected wave signal to generate an attenuated signal. The detector may be connected to the attenuator and configured to detect the attenuated signal to generate a detected signal representing an envelope of the attenuated signal. The first analog-to-digital converter may be connected to the detector and configured to perform an analog-to-digital conversion on the detected signal to generate a first converted signal. The filter may be connected between the first analog-to-digital converter and the main processor 110 and configured to filter the first converted signal to generate a first filtered signal as the aforementioned envelope signal.

The second preprocessor 140 may be connected between the microwave power source 220 and the main processor 110 and configured to: receive an analog pulse current signal from the microwave power source 220, process the analog pulse current signal to generate the digital pulse current signal, and transmit the digital pulse current signal to the main processor 110.

The second pre-processor 140 may include a second analog-to-digital converter and a filter. The second analog-to-digital converter 140 may be connected to the microwave power source 220 and configured to perform an analog-to-digital conversion on the analog pulse current signal to generate a second converted signal. The filter may be connected between the second analog-to-digital converter and the main processor 110 and configured to filter the second converted signal to generate a second filtered signal as the aforementioned digital pulse current signal.

It should be clear to those skilled in the art that the aforementioned filter may be implemented by FPGA8 or CPLD, the aforementioned main processor 110 may be implemented by an ARM processor, a digital signal processor or other processor (e.g., microprocessors), and the aforementioned filter and the aforementioned main processor 110 may be integrated together on a single system on chip (SOC).

Figure 2:
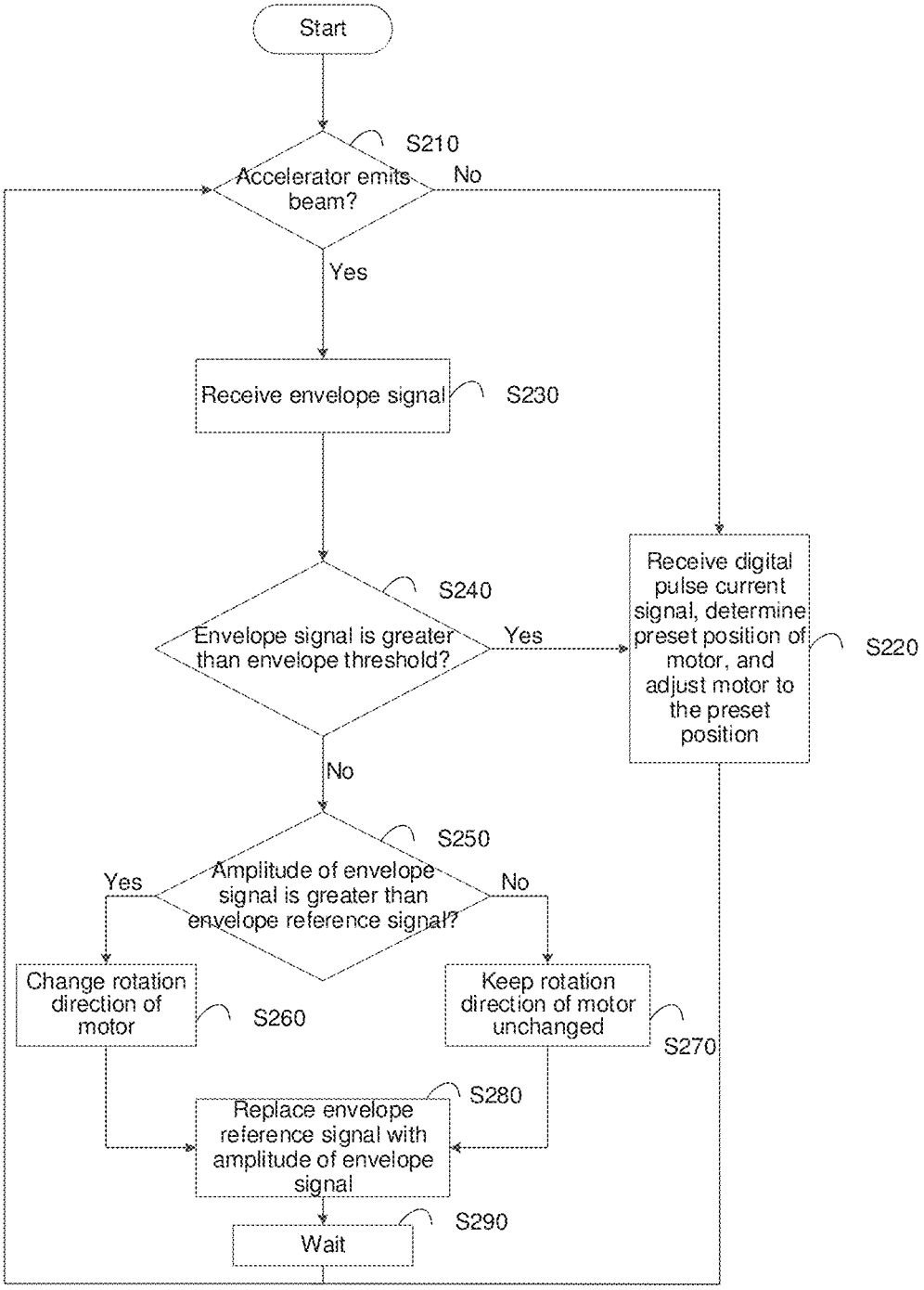
FIG. 2 shows a flowchart of a method of controlling a standing wave linear accelerator according to an embodiment of the disclosed technology.

FIG. 2 shows a flowchart of a method of controlling a standing wave linear accelerator 200 according to an embodiment of the disclosed technology. The standing wave linear accelerator 200 may include a microwave power source 220, an accelerating tube 210 and a motor 230. The microwave power source 220 may be connected between the accelerating tube 210 and the motor 230. The microwave power source 220 may be a magnetron or a klystron. The method includes the following steps.

In step S210, it is determined whether the standing wave linear accelerator 200 emits a beam. If it is determined that the standing wave linear accelerator 200 does not emit a beam, in step S220, if it is determined that the amplitude of the envelope signal is greater than the envelope threshold, a digital pulse current signal is received from the microwave power source 220, the preset position of the motor 230 is determined based on the digital pulse current signal, and the motor 230 is adjusted to the preset position. Step S220 may include: determining the preset position of the motor 230 by searching a pre-stored mapping relation table between the digital pulse current signal and the preset position based on the digital pulse current signal.

If it is determined that the standing wave linear accelerator 200 emits a beam, in step S230, the envelope signal of the reflected wave signal output by the accelerating tube 210 is received, and in step S240, it is determined whether the amplitude of the envelope signal is greater than the envelope threshold.

If it is determined that the amplitude of the envelope signal is greater than the envelope threshold, it can be determined that the reflected wave enters the total reflection state, and then the process goes to step S220.

If it is determined that the amplitude of the envelope signal is less than the envelope threshold, in step S250, it is determined whether the amplitude of the envelope signal is greater than the envelope reference signal.

If it is determined that the amplitude of the envelope signal is greater than the envelope reference signal, in step S260, it is determined to change the rotation direction of the motor 230; and if it is determined that the amplitude of the envelope signal is not greater than the envelope reference signal, in step S270, it is determined to keep the rotation direction of the motor 230 unchanged.

In step S280, the envelope reference signal is replaced with the amplitude of the envelope signal, and the amplitude of the envelope signal is stored in the memory.

In step S290, after a predetermined time, the process returns to step S210 to continue the above flow.

Compared with the phase-locked frequency detection Automatic Frequency Control (AFC) system, the apparatus of controlling the standing wave linear accelerator 200 according to the disclosed technology greatly reduces the number of components, increases the reliability of the system, and does not need to debug the circuit, which greatly reduces debugging difficulty and workload of the system. Moreover, compared with the minimum reflected wave AFC system, the apparatus of controlling the standing wave linear accelerator 200 according to the disclosed technology solves the problem that the motor's 230 rotation direction cannot be correctly determined when the reflected wave enters the total reflection state, keeps the reflected wave always in the minimum value state, and finally stabilizes the accelerator output dose in the maximum value state.

Figure 3:
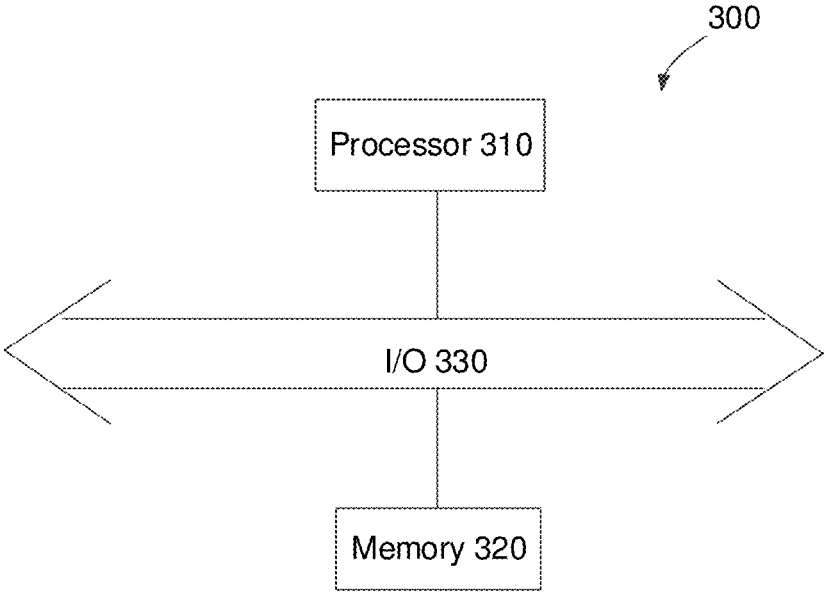
FIG. 3 shows a schematic diagram of a system for controlling a standing wave linear accelerator according to an embodiment of the disclosed technology.

FIG. 3 shows a schematic diagram of a system of controlling a standing wave linear accelerator 200 according to an embodiment of the disclosed technology. The system 300 may include a processor 310, for example, a digital signal processor (DSP). The processor 310 may be a single device or multiple devices for executing different actions of the processes described herein. The system 300 may also include an input/output (I/O) device 330 for receiving signals from or transmitting signals to other entities.

In addition, the system 300 may include a memory 320, which may have the following forms: non-volatile or volatile memory, for example, electrically erasable programmable read-only memory (EEPROM), flash memory, etc. The memory 320 may store computer-readable instructions that when executed by the processor 310, cause the processor to perform the actions described herein.

Some block diagrams and/or flowcharts are shown in the drawings. It should be understood that some blocks in the block diagrams and/or flowcharts or combinations thereof may be implemented by computer program instructions. These computer program instructions may be provided to the processor of general-purpose computer, special-purpose computer, or other programmable data processing devices, so that these instructions, when executed by the processor, may create means for implementing the functions/operations described in these block diagrams and/or flowcharts.

Therefore, the technology of the disclosed technology can be implemented in the form of hardware and/or software (including firmware, microcode, etc.). In addition, the technology of the disclosed technology may take the form of a computer program product on a computer-readable medium storing instructions, the computer program product can be used by an instruction execution system (for example, one or more processors) or used in combination with the instruction execution system. In the context of the disclosed technology, the computer-readable medium may be any medium that can contain, store, transfer, propagate, or transmit instructions. For example, the computer-readable medium may include, but is not limited to, an electric, magnetic, optical, electromagnetic, infrared, or semiconductor system, device or propagation medium. Specific examples of the computer-readable medium include: magnetic storage device, such as magnetic tape or hard disk (HDD); optical storage device, such as compact discs (CD-ROM); memory, such as random access memory (RAM) or flash memory; and/or wired/wireless communication link.

The above detailed description has explained a number of embodiments of the method, apparatus and system of controlling the standing wave linear accelerator by using schematic diagrams, flowcharts and/or examples. In the case where such schematic diagrams, flowcharts and/or examples contain one or more functions and/or operations, those skilled in the art should understand that each function and/or operation in such schematic diagrams, flowcharts or examples can be implemented individually and/or together through various structures, hardware, software, firmware or substantially any combination of them. In one embodiment, several parts of the subject matter described in the embodiments of the disclosed technology may be implemented by an application specific integrated circuit (ASIC), a field programmable gate array (FPGA), a digital signal processor (DSP), or other integrated formats. However, those skilled in the art should recognize that some aspects of the embodiments disclosed herein can be equivalently implemented in an integrated circuit, in whole or in part, as one or more computer programs running on one or more computers (for example, implemented as one or more programs running on one or more computer systems), implemented as one or more programs running on one or more processors (for example, implemented as one or more programs running on one or more microprocessors), implemented as firmware, or substantially implemented as any combination of the above methods. Further, according to the disclosed technology, those skilled in the art will have the ability to design circuits and/or write software and/or firmware code. In addition, those skilled in the art will recognize that the mechanism of the subject matter of the disclosed technology can be distributed as various forms of program products, and regardless of the specific type of signal carrier medium actually used to perform the distribution, the exemplary embodiments of the subject matter of the disclosed technology are all applicable. Examples of signal carrier medium include but are not limited to: recordable medium, such as floppy disk, hard drive, compact disk (CD), digital versatile disk (DVD), digital tape, computer storage, etc.; and transmission medium, such as digital and/or analog communication medium (for example, fiber optic cable, waveguide, wired communication link, wireless communication link, etc.).

What is claimed is:

1. An apparatus for controlling a standing wave linear accelerator, wherein the standing wave linear accelerator comprises an accelerating tube, a motor, and a microwave power source connected between the accelerating tube and the motor, the apparatus comprising:

a main processor configured to: receive an envelope signal of a reflected wave signal output by the accelerating tube, determine whether an amplitude of the envelope signal of the reflected wave signal output by the accelerating tube is greater than an envelope threshold, and if it is determined that the amplitude of the envelope signal of the reflected wave signal output by the accelerating tube is less than the envelope threshold, determine whether to change a rotation direction of the motor by comparing the amplitude of the envelope signal of the reflected wave signal output by the accelerating tube with an envelope reference signal stored in a memory; and the memory connected to the main processor and configured to store the envelope threshold and the envelope reference signal;

wherein the main processor is a digital signal processor.

2. The apparatus according to claim 1, wherein the main processor is further configured to:

determine to change the rotation direction of the motor if the amplitude of the envelope signal of the reflected wave signal output by the accelerating tube is greater than the envelope reference signal; and determine to keep the rotation direction of the motor unchanged if the amplitude of the envelope signal of the reflected wave signal output by the accelerating tube is not greater than the envelope reference signal.

3. The apparatus according to claim 2, wherein the main processor is further configured to:

replace the envelope reference signal with the amplitude of the envelope signal of the reflected wave signal output by the accelerating tube, and store the amplitude of the envelope signal of the reflected wave signal output by the accelerating tube in the memory.

4. The apparatus according to claim 3, wherein the microwave power source is a magnetron or a klystron.

5. The apparatus according to claim 2, wherein the microwave power source is a magnetron or a klystron.

6. The apparatus according to claim 1, wherein the main processor is further configured to:

if it is determined that the amplitude of the envelope signal of the reflected wave signal output by the accelerating tube is greater than the envelope threshold, receive a digital pulse current signal from the microwave power source, determine a preset position of the motor based on the digital pulse current signal, and adjust the motor to the preset position.

7. The apparatus according to claim 6, wherein the main processor is further configured to:

determine the preset position of the motor by searching a pre-stored mapping relation table between the digital pulse current signal and the preset position based on the digital pulse current signal.

8. The apparatus according claim 6, wherein the microwave power source is a magnetron or a klystron.

9. The apparatus according to claim 1, further comprising:

a first preprocessor connected between the main processor and the accelerating tube, wherein the first preprocessor is configured to: receive the reflected wave signal from the accelerating tube, process the reflected wave signal to generate the envelope signal of the reflected wave signal output by the accelerating tube, and transmit the envelope signal of the reflected wave signal output by the accelerating tube to the main processor; and a second preprocessor connected between the main processor and the microwave power source, wherein the second preprocessor is configured to: receive an analog pulse current signal from the microwave power source, process the analog pulse current signal to generate the digital pulse current signal, and transmit the digital pulse current signal to the main processor.

10. The apparatus according to claim 9, wherein the first pre-processor comprises an attenuator, a detector, a first analog-to-digital converter, and a filter, wherein:

the attenuator is connected to the accelerating tube and configured to attenuate the reflected wave signal to generate an attenuated signal;

the detector is connected to the attenuator and configured to detect the attenuated signal to generate a detected signal representing an envelope of the attenuated signal;

the first analog-to-digital converter is connected to the detector and configured to perform an analog-to-digital conversion on the detected signal to generate a first converted signal; and the filter is connected between the first analog-to-digital converter and the main processor and configured to filter the first converted signal to generate a first filtered signal as the envelope signal of the reflected wave signal output by the accelerating tube.

11. The apparatus according to claim 9, wherein the second pre-processor comprises a second analog-to-digital converter and a filter, wherein:

the second analog-to-digital converter is connected to the microwave power source and configured to perform an analog-to-digital conversion on the analog pulse current signal to generate a second converted signal; and the filter is connected between the second analog-to-digital converter and the main processor and configured to filter the second converted signal to generate a second filtered signal as the digital pulse current signal.

12. The apparatus according to claim 1, wherein the microwave power source is a magnetron or a klystron.

13. A method of controlling a standing wave linear accelerator, wherein the standing wave linear accelerator comprises an accelerating tube, a motor, and a microwave power source connected between the accelerating tube and the motor, the method comprising:

receiving an envelope signal of a reflected wave signal output by the accelerating tube; and determining whether an amplitude of the envelope signal of the reflected wave signal output by the accelerating tube is greater than an envelope threshold, and if it is determined that the amplitude of the envelope signal of the reflected wave signal output by the accelerating tube is less than the envelope threshold, determining whether to change a rotation direction of the motor by comparing the amplitude of the envelope signal of the reflected wave signal output by the accelerating tube with an envelope reference signal stored in a memory;

wherein the envelope signal of the reflected wave signal output by the accelerating tube is a digital signal.

14. The method according to claim 13, wherein the determining whether to change a rotation direction of the motor by comparing the amplitude of the envelope signal of the reflected wave signal output by the accelerating tube with an envelope reference signal comprises:

determining to change the rotation direction of the motor if the amplitude of the envelope signal of the reflected wave signal output by the accelerating tube is greater than the envelope reference signal; and determining to keep the rotation direction of the motor unchanged if the amplitude of the envelope signal of the reflected wave signal output by the accelerating tube is not greater than the envelope reference signal.

15. The method according to claim 14, further comprising:

replacing the envelope reference signal with the amplitude of the envelope signal of the reflected wave signal output by the accelerating tube, and storing the amplitude of the envelope signal of the reflected wave signal output by the accelerating tube in the memory.

16. The method according to claim 15, wherein the microwave power source is a magnetron or a klystron.

17. The method according to claim 14, wherein the microwave power source is a magnetron or a klystron.

18. The method according to claim 13, further comprising:

if it is determined that the amplitude of the envelope signal of the reflected wave signal output by the accelerating tube is greater than the envelope threshold, receiving a digital pulse current signal from the microwave power source, determining a preset position of the motor based on the digital pulse current signal, and adjusting the motor to the preset position.

19. The method according to claim 18, wherein the determining a preset position of the motor based on the digital pulse current signal comprises:

determining the preset position of the motor by searching a pre-stored mapping relation table between the digital pulse current signal and the preset position based on the digital pulse current signal.

20. The method according to claim 13, wherein the microwave power source is a magnetron or a klystron.

* * * * *